United States Patent [19]

Secretan

[11] 3,997,230

[45] Dec. 14, 1976

[54] CONNECTOR FOR SMALL DIAMETER TOWED SONAR ARRAY

[75] Inventor: Stanley Secretan, Leona Valley, Calif.

[73] Assignee: The Bendix Corporation, North Hollywood, Calif.

[22] Filed: May 2, 1975

[21] Appl. No.: 574,152

[52] U.S. Cl. ..... 339/49 R; 339/89 M; 339/94 M; 340/7 R

[51] Int. Cl.[2] ..... H01R 25/00

[58] Field of Search ..... 339/47–49, 339/89 R, 89 C, 89 M, 94 R, 94 A, 94 C, 94 M, 104; 340/7

[56] References Cited

UNITED STATES PATENTS

| | | | |
|---|---|---|---|
| 2,465,696 | 3/1949 | Paslay | 340/7 |
| 2,828,473 | 3/1958 | High | 339/89 R |
| 3,184,706 | 5/1965 | Atkins | 339/94 C |
| 3,441,898 | 4/1969 | Nodfelt | 339/48 |
| 3,657,681 | 4/1972 | Falkner | 339/94 M |
| 3,713,085 | 1/1973 | Laurent | 340/7 |
| 3,812,455 | 5/1974 | Pearson | 339/49 R |

*Primary Examiner*—Roy Lake
*Assistant Examiner*—Mark S. Bicks
*Attorney, Agent, or Firm*—Robert C. Smith; William F. Thornton

[57] ABSTRACT

A connector for a small diameter towed sonar array is used to couple similar sections together. Each section includes a sheath or tubing of flexible plastic material such as polyvinylchloride clamped at each end tightly around a cylindrical metal coupling member having threads extending external of said tubing. Held adjacent the internal surfaces of the coupling members at the outside ends thereof are a pair of connector members which include a plurality of concentric conductor tracks. When adjacent sections are joined, these conductor tracks are pressed tightly together, partly as a result of the force exerted by flexible plastic spacers which abut against internal shoulders of the coupling members and the connector, urging the connector members outwardly against each other. A glass header member with a plurality of conducting pins therethrough is sealed to the inside of the coupling member, and wires therefrom connect with the individual conductor tracks, thereby providing electrical continuity and a high pressure seal across the junction. Also located within each of said coupling members are a pair of mating clamp members which engage a cylindrical collar having a mating wedging surface to capture and retain a plurality of rope members of strong synthetic material. Electrical conductors also pass through passageways in these clamp members and are connected to the conducting pins. The sections are joined by means of a collar having right hand-left hand internal threads engaged with the external threads of the coupling members to thereby pull said coupling members together.

7 Claims, 5 Drawing Figures

CONNECTOR FOR SMALL DIAMETER TOWED SONAR ARRAY

BACKGROUND OF THE INVENTION

At the present time there are available towed arrays of hydrophones which are pulled behind a ship and which are designed to detect underwater sounds in the area including those indicating the presence of submarines. Such arrays normally include a series of interconnected hydrophones and electronic modules carried in a long section of jacket or tubing. Such sections may be on the order of 50 to 70 feet long and are designed to be connected together end to end so that several such sections may be used. Such arrays need to be substantially neutrally buoyant and so are usually filled with a positively buoyant, acoustically transparent liquid such as "Shellsol 72", a product of Shell Oil Co., which is a hydrocarbon somewhat similar to kerosene but lighter. Since such towed arrays are usually of the order of three inches (7.6 cm) in diameter, they are heavy to reel and to store, they constitute a heavy drag load to be pulled through the water, and they require huge reels for their storage on board ship. It is therefore desirable that such arrays be made which are subtantially smaller in diameter than those discussed above. A substantial reduction in diameter would alleviate all the problems referred to but could introduce other problems such as how to minimize the size, particularly the diameter, of many of the components to be placed in such an array. Not the least of the problems resides in the provision of connectors for such small diameter arrays which are rugged, convenient to couple, which provide positive integrity against the entry of sea water at substantial depths and leadage of the internally contained fluid, which provide and maintain electrical connections, and which are otherwise strong enough to withstand the axial loads applied while towing a number of such array sections.

DESCRIPTION OF THE PREFERRED EMBODIMENT

Figure 1A:
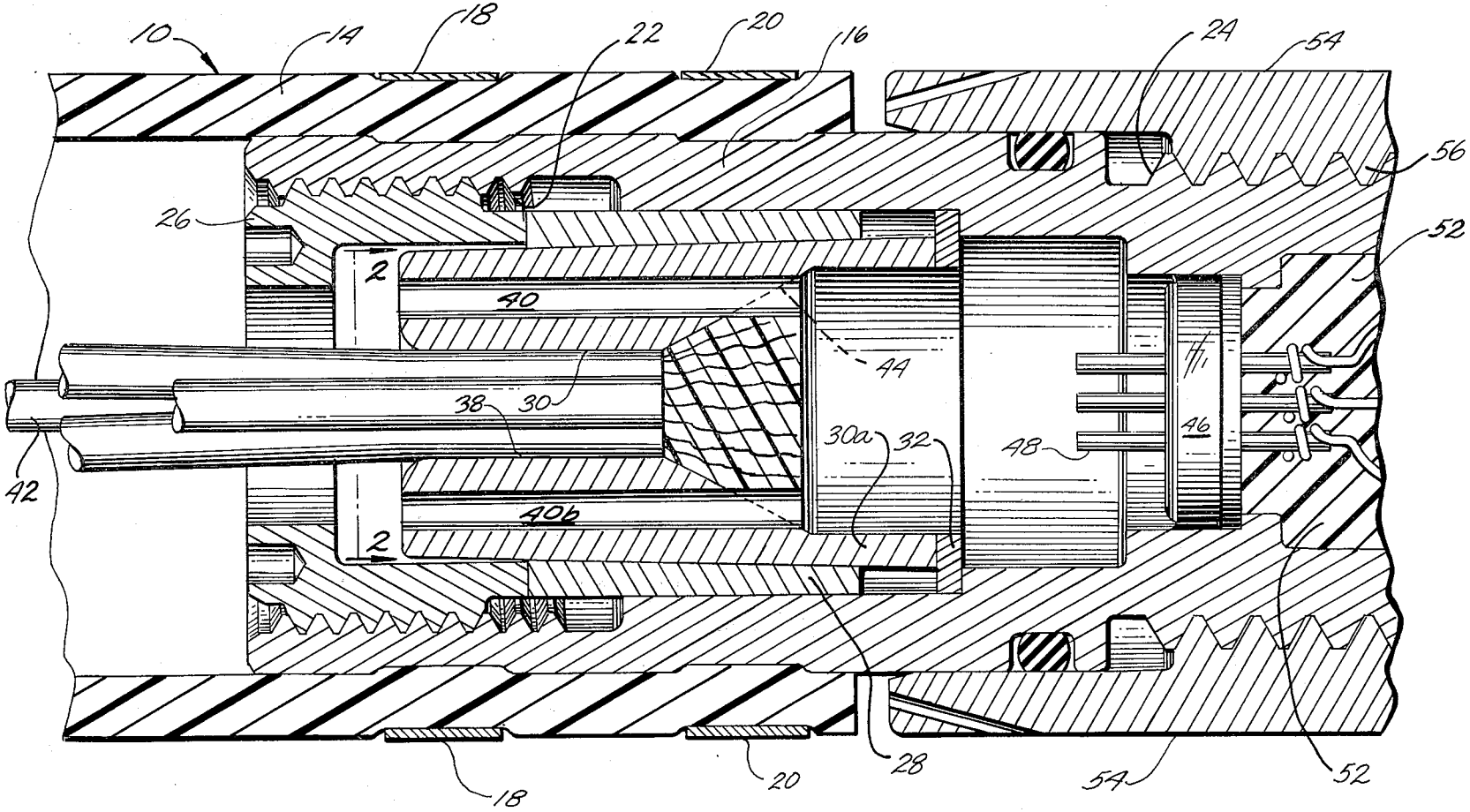
FIG. 1A is a sectional view of one end of a small diameter array showing one coupling member and associated parts joined to part of a second such coupling member.
Figure 1B:
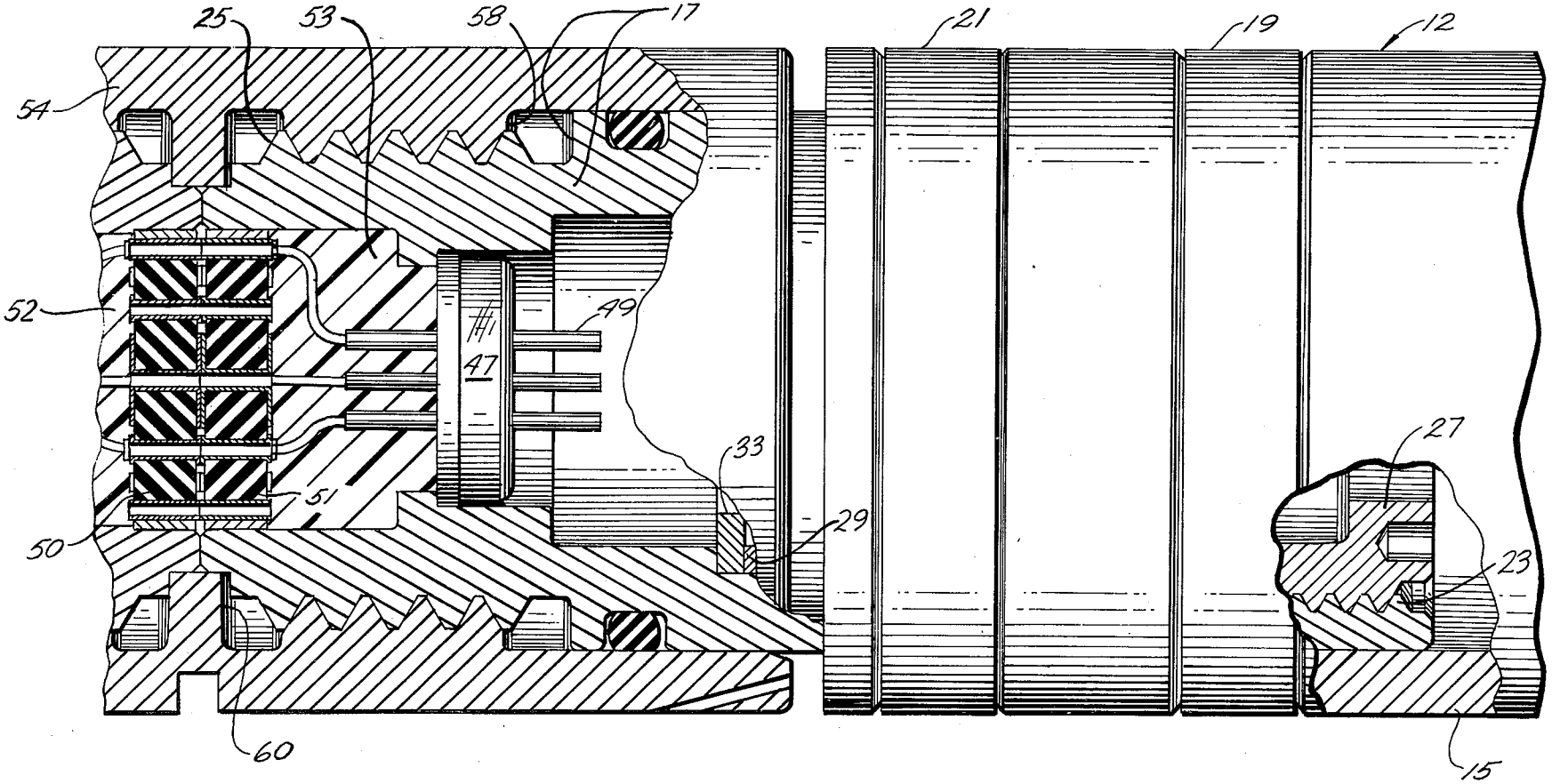
FIG. 1B is a sectional view constituting an extension of FIG. 1A and showing the remainder of the second such coupling member.
Figure 2:
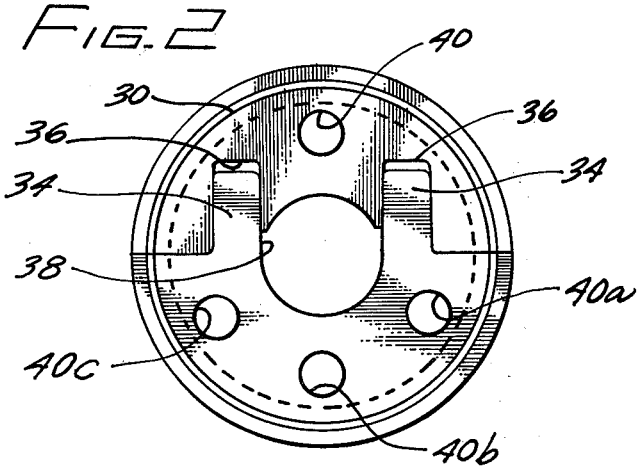
FIG. 2 is a sectional view taken along line 2—2 of FIG. 1A.

Referring now to FIGS. 1A and 1B, a first array section is shown at numeral 10 which is joined to a second array section 12 (FIG. 1B) by means of a coupling structure discussed below. A length of polyvinylchloride tubing 14 is securely clamped to a metal coupling member 16 by means of stainless steel rings 18 and 20. It will be observed that rings 18 and 20 are applied directly opposite a pair of shallow indentations in the surface of coupling member 16 such that as the rings are compressed through deformation of the metal, the tubing is deformed into these indentations, thus securing the tubing very tightly to the coupling 16. A similar length of tubing 15 is clamped to an opposing coupling member 17 by means of similar steel rings 19 and 21. Coupling 16 has internal threads at numeral 22 and external threads 24 at its outboard end. Similarly, coupling 17 has internal threads 23 and external threads 25. Internal threads 22 and 23 are threadedly engaged with hollow nut members 26 and 27, respectively, which abut against tapered collars 28 and 29. As member 26 is engaged with more of threads 22, the collar member 28 is forced toward the right, thereby wedging it tightly around a pair of members 30 and 30*a* which constitute a generally cylindrical clamp assembly. An identical clamp assembly (not shown) is positioned within members 27 and 29. Members 30 and 30*a* abut against a washer 32 which, in turn, is held against an internal shoulder in coupling member 16. The configuration of members 30 and 30*a* may become more apparent from consideration of FIG. 2 wherein it will be seen that member 30*a* includes a pair of projections 34 received in mating slots 36 of member 30, and these two members cooperate to provide a cylindrical opening 38. A plurality of other small diameter cylindrical openings 40, 40*a*, 40*b* and 40*c* are also provided parallel to the cylindrical opening 38. A plurality of strands of a strong synthetic rope, which may be duPont Kevlar or similar strong synethic fiber, pass through opening 38 and are firmly held in position as the nut 26 is turned inwardly, forcing collar 28 axially against a mating tapered surface on members 30 and 30*a* and clamping said members tightly together around the rope strands 42. At the outboard end (with respect to array section 10), the assembly consisting of members 30 and 30*a* is tapered outwardly at numeral 44 to provide a conical chamber into which many idividual fibers and groups of fibers of the strands of ropes 42 are potted in a suitably epoxy glue. In this manner, the strands are incorporated into a solid plug of such shape and diameter as to provide great resistance to being removed from the connector assembly by means of an axial force toward the left. A similar rope is secured within coupling member 17 by means of an identical structure.

Glass header members 46 and 47 abut against internal shoulders in coupling members 16 and 17 and include a plurality of electrical conducting pins 48 and 49 therethrough. Electrical leads from the various components housed within the array sections (not shown) are passed through passages 40, 40*a*, 40*b* and 40*c* and are connected to the pins 48. Similar leads are connected to pins 49. At the outboard end of coupling members 16 and 17 are a pair of connectors 50 and 51, each of which consists of a small cylindrical wafer of insulating material having a plurality of small diameter plated-through holes making contact with a plurality of concentric printed circuit conductor tracks on the outside. A plurality of leads are connected between the pins 48 and 49 and the plated-through holes in connectors 50 and 51, thus providing electrical continuity to the conductor tracks. This structure is shown and described in greater detail below. The outboard end of pins 48 and 47 and the attached conductors ae potted or encapsulated in flexible plastic insulating members 52 and 53 which have inherent resiliency tending to force each of connectors 50 and 51 axially outwardly against its opposite member. Members 52 and 53 should be of a material which will not take a permanent set from compression as the coupling members 16 and 17 are held together.

Figure 3:
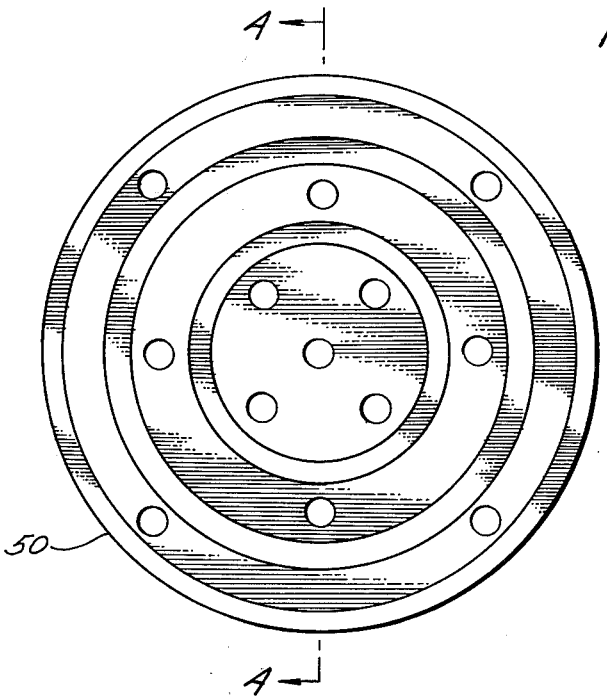
FIG. 3 is an enlarged plan view of one of the connecting members shown in FIG. 1A.
Figure 4:
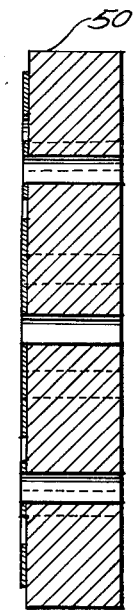
FIG. 4 is a sectional view through the connecting member of FIG. 3.

FIG. 3 is a plan view showing the face of connector 50. Connector 51 is identical. A plurality of concentric flat conductor tracks are formed on the face of the connector such that when two such faces are pressed together, electrical continuity from one set of tracks to the other is assured. The ends of the various plated-through holes providing continuity to the tracks from the conductors on the opposite side are shown intersecting the individual tracks. These plated-through holes are shown in detail in FIG. 4, which is a sectional view through the connector shown in FIG. 3.

An internally threaded collar 54 has left-hand internal threads 56 and right-hand internal threads 58 which, in operation, are threadedly engaged with external threads 24 and 25. Collar 54 also has a centrally located internal shoulder 60 which serves as a stop for one or both of said coupling members 16 and 17.

To separate the sections 10 and 12, the collar 54 is turned such that the members 16 and 17 move apart until one or both are separated from the collar. To couple the sections, they are each inserted into collar 54 and said collar is rotated in the opposite direction until one of coupling members 16 and 17, e.g., coupling 16, abuts against shoulder 60. At this point said coupling member 17 will be close to the shoulder 60, and connector members 50 and 51 may have made contact with each other or are about to make contact. Further turning of collar 54 causes coupling member 17 to move toward shoulder 60. At the same time, conductor tracks of connector 51 are turned such that they make a wiping contact with the conductor tracks of connector 50 as they move axially into tighter engagement therewith, thereby compressing the encapsulating material 52 and 53.

With the structure described above, the electronic equipment carried within tubing sections 14 and 15 (not shown) is connected to the conducting pins 48, 59, and the positively buoyant fluid carried within the tubing surrounds the equipment and is retained at each end of an array section by the header members 46, 47. Resistance to axial forces is provided by the multistrand rope of synthetic material 42 which is firmly anchored in each coupling member as described and which prevents the forces between the coupling members from being carried by the wires or the tubular jacket. Since the coupling members 16, 17 and collar 54 are of metal, they can easily be made of dimensions to carry such axial loads although it is preferable that sleeve 54 not significantly exceed the diameter of the tubing. The structure shown herein has been used to provide a means for coupling arrays of approximately 1 inch diameter, although it could be scaled either upward or downward somewhat, depending upon requirements and the forces encountered.

I claim:

1. A coupling assembly for joining two sections of a small diameter towed sonar array wherein each section includes a sheath of flexible tubing material enclosing hydrophones and associated interconnected electronic equipment and an axially extending strength member in the form of a multistrand rope of synthetic fiber in an enclosed environment of positively buoyant dielectric fluid;

said assembly comprising, in each section to be joined, a cylindrical coupling member having a set of inboard internal threads, a set of outboard external threads and a plurality of internal shoulders, a collar having a tapered internal surface positioned internally of said coupling member, a pair of mating semicylindrical clamp members having tapered surfaces adjoining the tapered internal surface of said collar, said clamp members as assembled including an axial bore therethrough receiving said rope, a plurality of passageways parallel to said bore and an outboard conical bore, means threadedly engaged with said internal threads for forcing said collar axially outwardly and clamping said clamp members tightly around said rope, a header member of insulating material abutting against one of said internal shoulders and sealed to the inside surface of said coupling member and a plurality of electrically conducting pins extending through said header member, a connector member internally of and positioned at the outboard end of said coupling member comprising a wafer of insulating material having a plurality of concentric conductor tracks;

conductor means connecting said tracks with said conducting pins, and an internally threaded collar having left-hand threads near one end and right-hand threads near the other end threadedly engaged with the external threads of said coupling members of sections to be joined such that as said collar is turned in one direction said coupling members are pulled together forcing said concentric conductor tracks together.

2. A coupling assembly as set forth in claim 1 wherein a flexible insulating material is used to encapsulate said conducting pins and said conductor means outboard of said header member, said material being sufficiently resilient to impose a significant outward axial force on said connector member.

3. A coupling assembly as set forth in claim 1 wherein the ends of said rope strands are frayed into a large number of individual fibers and groups of fibers within said conical bore and said fibers and groups of fibers are encapsulated in an epoxy cement.

4. A coupling assembly as set forth in claim 1 wherein the components within each said section are exposed to said fluid inboard of said header member at each end.

5. A coupling assembly as set forth in claim 1 wherein said internally threaded collar has a generally centrally positioned internal shoulder such that when one of said coupling members bottoms on said shoulder, the adjoining coupling member must rotate somewhat before it also bottoms on said shoulder thus pressing said connector members together with a wiping action.

6. A coupling assembly as set forth in claim 1 wherein each of said coupling members includes an external groove and an O-ring sealing member in said groove provides an external pressure seal against said internally threaded collar.

7. A coupling assembly as set forth in claim 6 wherein said coupling member includes additional shallow external grooves and ring clamps are fastened to the outside of said sheath forcing a portion of said sheath into said shallow grooves.

* * * * *